US008470058B2

(12) United States Patent
Paggi

(10) Patent No.: US 8,470,058 B2
(45) Date of Patent: Jun. 25, 2013

(54) DIESEL FUEL COMBUSTION ENHANCING ADDITIVE

(75) Inventor: Raymond Edward Paggi, Winchester, VA (US)

(73) Assignee: Best Tech Brands LLC, Houston, TX (US)

( * ) Notice: Subject to any disclaimer, the term of this patent is extended or adjusted under 35 U.S.C. 154(b) by 0 days.

(21) Appl. No.: 13/207,251

(22) Filed: Aug. 10, 2011

(65) Prior Publication Data

US 2012/0036766 A1 Feb. 16, 2012

Related U.S. Application Data

(60) Provisional application No. 61/372,092, filed on Aug. 10, 2010.

(51) Int. Cl.
*C10L 1/14* (2006.01)
*C10L 1/23* (2006.01)
*C10L 1/04* (2006.01)

(52) U.S. Cl.
USPC ..... 44/457; 44/324; 44/436

(58) Field of Classification Search
USPC ..... 44/439, 389, 443, 447, 323, 324, 44/436, 457; 123/1 A
See application file for complete search history.

(56) References Cited

U.S. PATENT DOCUMENTS

| | | | | |
|---|---|---|---|---|
| 1,405,809 | A | 2/1922 | Whitaker | |
| 2,402,863 | A | 6/1946 | Zuidema et al. | |
| 4,131,434 | A | 12/1978 | Gonzalez | |
| 4,623,363 | A * | 11/1986 | Zaweski et al. | 44/305 |
| 4,915,707 | A | 4/1990 | Whitworth | |
| 5,501,713 | A | 3/1996 | Wilkins, Jr. | |
| 5,575,822 | A | 11/1996 | Wilkins, Jr. | |
| 5,591,237 | A * | 1/1997 | Bell | 44/325 |
| 5,607,486 | A | 3/1997 | Wilkins, Jr. | |
| RE37,629 | E | 4/2002 | Wilkins, Jr. | |
| 6,858,047 | B1 | 2/2005 | Norman | |
| 2002/0026744 | A1 * | 3/2002 | Golubkov et al. | 44/436 |
| 2003/0167679 | A1 | 9/2003 | Jordan | |
| 2009/0107035 | A1 * | 4/2009 | Leung | 44/389 |
| 2010/0031558 | A1 | 2/2010 | Goss et al. | |
| 2010/0325944 | A1 * | 12/2010 | Yang et al. | 44/322 |

FOREIGN PATENT DOCUMENTS

WO WO 2009/113080 9/2009

OTHER PUBLICATIONS

PCT Search Report and Written Opinion for International Application No. PCT/US2011/047278 dated Oct. 28, 2011.

* cited by examiner

*Primary Examiner* — Pamela H Weiss
(74) *Attorney, Agent, or Firm* — David B. Dickinson

(57) ABSTRACT

Embodiments disclosed herein generally relate to the use of low concentration additives comprising a terpene and a cetane improver in diesel fuel to rapidly promote fuel atomization and air mixing in the combustion chamber and thereby increase the fuel efficiency and reduce harmful $NO_x$ and particulate exhaust emissions.

15 Claims, 5 Drawing Sheets

DIESEL FUEL COMBUSTION ENHANCING ADDITIVE

CROSS-REFERENCE TO RELATED APPLICATIONS

This application claims benefit of U.S. provisional patent application Ser. No. 61/372,092, filed Aug. 10, 2010, which is herein incorporated by reference in its entirety.

BACKGROUND OF THE INVENTION

1. Field of the Invention

Embodiments of the present invention generally relate to fuel additives in internal combustion engines and boilers. More particularly, the invention discloses a composition of matter and processes for improving fuel efficiency and reducing harmful exhaust emissions in diesel engines.

2. Description of the Related Art

In a diesel-fueled engine, the single-most limiting parameter is poor air utilization. The fuel is sprayed into the combustion chamber as a liquid stream when the piston is very close to top dead center, leaving very little time for atomization and mixing. Fuel will only burn when atomized and mixed with air, so the liquid fuel in the core of the spray begins to pyrolyze and form solid matter. Greater amounts of particulate matter are produced at higher loads, where relatively large amounts of fuel need to be atomized in less than a millisecond. Additionally, as more time is consumed to atomize the fuel, the production of $NO_x$ increases.

Engine manufacturers currently address this problem by installing very high pressure fuel injection equipment to assist in atomization. However, the pumping loss directly attributable to this high pressure injection robs 10 to 15% of the engine's energy output. Engine manufacturers also presently rely heavily on exhaust gas recirculation (EGR) to control $NO_x$ emissions. EGR, however, lowers the bulk gas temperature, lowers work output and causes combustion instability. The use of biodiesel further stresses the efficient execution of combustion due to its lower volatility and the high oxygen content of the fuel (>10%). Moreover, the gums and deposits that the biodiesel tends to build on the injectors and in the combustion chamber itself compromise the combustion process.

Detergent fuel additives are well known as capable of restoring lost fuel economy and reducing exhaust emissions by removing deposits on injector nozzles and in the combustion chamber. Even so, these fuel additives cannot improve combustion beyond a clean engine. Metallic based fuel additives are also well-know combustion enhancing additives and can improve performance and reduce particulate matter formation in a diesel engine. However, these metal based additives are known to poison catalysts and have harmful effects on humans and the environment.

An improved way of quickly dispersing the liquid fuel spray and atomizing the fuel is desirable. There remains a need for a fuel additive technology which significantly enhances engine efficiency and reduces harmful exhaust emissions without imposing harmful side effects.

SUMMARY OF THE INVENTION

Embodiments disclosed herein generally relate to fuel additives in internal combustion engines and boilers. In one embodiment, an additive composition for mixing with diesel fuel is provided, the additive composition comprising a liquid phase terpene and a cetane enhancer. In another embodiment, the terpene is d-limonene. In another embodiment, the cetane enhancer is 2-ethylhexylnitrate.

In another embodiment, a method for igniting a diesel engine is provided. The method comprises the steps of (a) adding an additive comprising a liquid phase terpene and a cetane enhancer to a diesel fuel to form a mixture, (b) adding the mixture to the diesel engine, and (c) igniting the diesel engine. In one embodiment, the terpene is d-limonene and the cetane enhancer is 2-ethylhexylnitrate.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
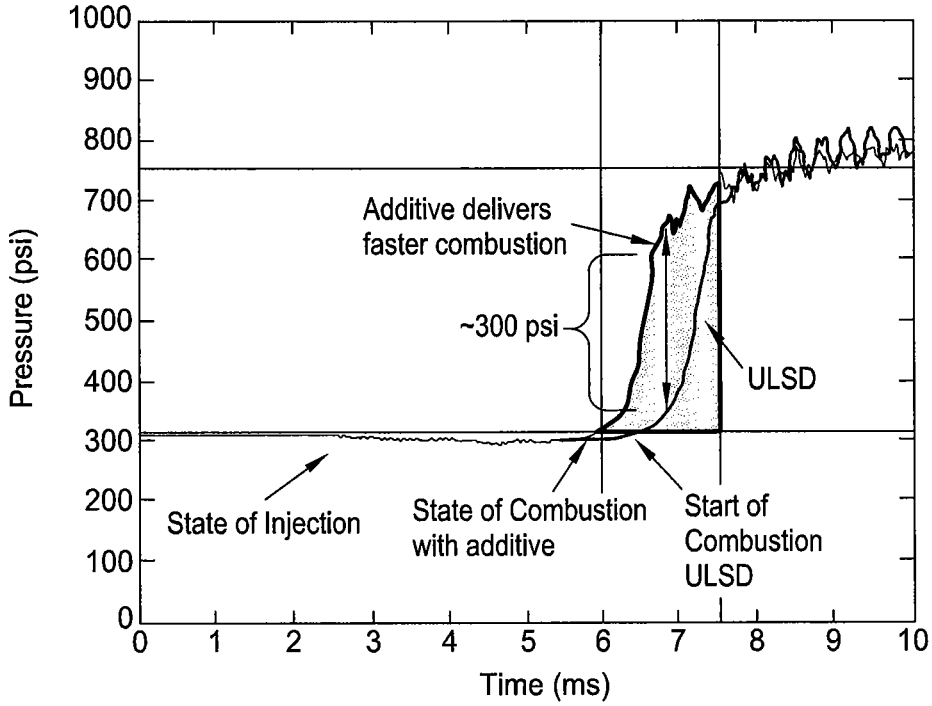
FIG. 1 shows pressure versus time curves for base fuel and fuel mixed with an additive according to one embodiment.

Embodiments disclosed herein generally relate to fuel additives in internal combustion engines and boilers. More particularly, the invention discloses a composition comprising a terpene, such as d-limonene, and a cetane improver, such as 2-ethylhexylnitrate, for improving fuel efficiency and reducing harmful exhaust emissions in diesel engines. The terpene ingredient of the present invention is made from agricultural waste such as citrus rinds and from water, imparting a very favorable carbon footprint.

It has surprisingly been found that d-limonene, which has a very high octane number, can significantly improve fuel economy and reduce harmful exhaust emissions when used at very low concentrations with a cetane improver such as 2-ethylhexylnitrate.

D-limonene has been surprisingly discovered to significantly advance the initiation of combustion in diesel fuel and thereby shorten the combustion event, leading to higher fuel efficiency and dramatically lower $NO_x$ and particulate exhaust emissions. This discovery is unexpected since d-limonene is well known for its high octane number (106 RON) which would severely degrade the ignition quality of diesel fuel and retard the initiation of combustion.

Without being limited in any way to this mechanism, it is believed that when d-limonene is exposed to very high temperatures and pressures as in the combustion chamber of an engine, the molecule rapidly disperses the liquid fuel spray.

Limonene ($C_{10}H_{16}$) is found in high concentrations in, among other things, citrus fruits. Limonene, which is the terpene of preference for preparing fuel additives ignition of this invention, may be commercially obtained from Florida Chemical Company, Inc. in three different grades, named untreated/technical grade, food grade, and lemon-lime grade. The food grade comprises about 97% d-limonene, the untreated/technical grade contains about 95% d-limonene, and the lemon-lime grade contains about 70% d-limonene, the balance in all three grades being other terpene hydrocarbons and oxygenated compounds. The technical and food grades of limonene are the most preferred for use in this invention.

D-limonene (4-isopropenyl-1-methylcyclohexene), the more common limonene isomer, is innocuous at ambient temperature and carries a rating of Normally Regarded As Safe (UN NRAS). However, limonene has a flash point in the range of about 113° F. to about 124° F., depending upon the purity of the material. Thus, when exposed to a high temperature, such as the temperature developed by the heat of compression in a combustion chamber, which is greater than 1000° F., the d-limonene quickly cracks in two, creating two moles of isoprene gas so an initial expansion of the fuel spray occurs. The reaction product is a well-known peroxide generator and is classified as strongly explosive in the Handbook of Reactive Chemicals (6th edition, Volume 2). A micro-explosive event then ensues which causes rapid dispersion of the liquid fuel spray, enhancing mixing of the liquid fuel with the hot air, speeding up the atomization and mixing with the bulk air charge. Because this rapid atomization process however also affects low cetane components of the fuel, such as aromatics, a cetane enhancer such as 2 ethyl hexyl nitrate may be added to rapidly promote the auto-ignition of the aromatics in the gas phase.

Cetane enhancers/improvers improve fuel detonation characteristics, particularly where the fuel composition is used in compression ignited engines. Examples of cetane enhancers include nitrates, nitrites, and peroxides. The preferred cetane improver is 2-ethylhexylnitrate (2-EHN), available from Ethyl Corporation under the trade designation "HITECH 4103". Although any isomer of 2-EHN is preferred in the additive described herein, di-tert-butyl peroxide (DTBP) ($C_8H_{18}O_2$) may also be used. Ammonium nitrate may also be used as a cetane improver with the additional benefit of possessing emulsion stabilization properties. Preferred compositions include about 0.1% to 0.4% by weight of the cetane enhancer.

Additive compositions described herein comprise a liquid phase terpene and a cetane improver. In one embodiment, the additive may include about 10% to about 25% by weight of 2-ethylhexylnitrate and about 75% to about 90% by weight of d-limonene. In another embodiment, the additive may preferably include about 15% to about 20% by weight of 2-ethylhexylnitrate and about 80% to about 85% by weight of d-limonene. Preferably, the concentration of terpene/cetane improver additive in the fuel is below about 0.0075% by weight. The d-limonene additive so formed is then admixed with the fuel to be treated in order to improve fuel economy, and reduce $NO_x$ and particulates emitted by the exhausts of engines powered by the fuel composition. Preferred concentrations shown to deliver these benefits range from about 0.0007% to about 0.01% by weight of the additive in diesel fuel. In other embodiments, the fuel includes about 0.001% to about 0.005% by weight of additive. The diesel fuel may be any diesel fuel meeting ASTM diesel fuel requirements, including biodiesel fuel.

In another embodiment, one liter of additive may be prepared by mixing 830 ml of d-limonene with a purity ranging from 93% to 100%, more preferably ranging from 96% to 100%, with 170 ml of 2-ethylhexylnitrate. The resultant mixture described above is then used as a fuel additive in concentrations ranging from 500 ppm to 10,000 ppm by weight, and more preferably from 800 ppm to 2,500 ppm by weight.

Heat generation by ignition of the limonene compares favorably with heat generation from presently used carbonaceous solid fuel lighter fluids derived from petrochemical distillates. FIG. 1 shows pressure versus time curves taken from the industry standard Ignition Quality Test, ASTM 6890/08. This test utilizes a combustion vessel that has a volume similar to a single cylinder of a heavy duty diesel engine when the piston is close to top dead center, just before the fuel is injected. The pressure and temperature of the air in the combustion bomb is also similar to the conditions in the combustion just before fuel injection. This test eliminates much of the variability associated with engine testing. Each pressure curve was built from data taken at 10,000 samples per second and the one shown in FIG. 1 is an average of 32 individual test runs (over 1,000 test runs were conducted with a d-limonene and 2-ethylhexylnitrate additive with similar results). The additive used had about 83% by weight of d-limonene and about 17% by weight of 2-ethylhexylnitrate added to the base fuel at a concentration of about 2200 ppm by weight. As can be seen from FIG. 1, the d-limonene and 2-ethylhexylnitrate additive starts combustion earlier than ultra low sulfur diesel (ULSD). It can also be seen that the slope of the curve is steeper with the additive, demonstrating that more of the fuel is releasing energy earlier than with ULSD (the shaded area represents the amount of work being done). This generates a higher brake mean effective pressure, which in turn, reduces fuel consumption (BSFC=Fuel consumption/BMEP). (The shaded area represents the work performed in each cycle.) This data show that the additive acts as a fuel combustion enhancer.

The shortened combustion event also serves to reduce the formation of $NO_x$ in the exhaust. This quicker heat release converts more of the fuel chemical energy into usable work on the piston top at top dead center, where the theoretical optimum constant volume cycle efficiency occurs. Moreover, the technology also reduces particulate matter by limiting or eliminating the pyrolysis reactions inside the liquid fuel spray.

Reference will now be made in detail to specific aspects of the disclosed materials, compounds, compositions, articles, and methods, examples of which are illustrated in the accompanying Examples. D-limonene and 2-ethylhexylnitrate additives were evaluated for their performance in improving fuel economy by conducting tests on medium and heavy duty trucks. The engines in these tests ranged in size from 5.9 liters and 250 horsepower to over 15 liters and 600 horsepower. The reference fuel used as base stock in the tests conducted below was ultra low sulfur diesel (ULSD) fuel. It should be noted, however, that the additives described herein can be used with other types of diesel fuel, and not just ultra low sulfur diesel. These tests measured fuel economy improvements ranging from 10 to 23%. The following examples will further describe the invention. These examples are intended only to be illustrative. Other variations and modifications may be made in form and detail described herein without departing from or limiting the scope of the invention which is determined by the attached claims.

EXAMPLE 1

One liter of additive is prepared by mixing 830 ml of d-limonene with a purity of 97% with 170 ml of 2-ethylhexylnitrate.

EXAMPLE 2

Figure 2:
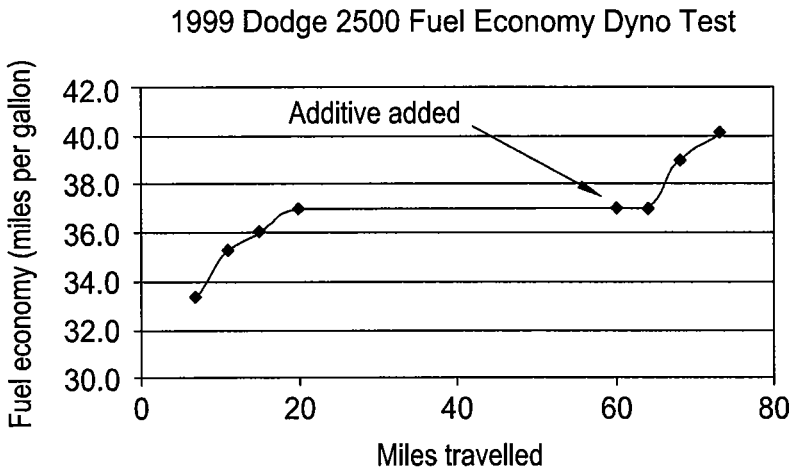
FIG. 2 shows a graph of miles travelled versus fuel economy for base fuel and fuel mixed with an additive according to one embodiment.

A 1999 Dodge pick-up truck equipped with a 5.9 liter Cummins Turbo engine was tested on a chassis dynamometer at 50 miles per hour at level road load. As shown in FIG. 2, the truck's fuel economy stabilized after 20 miles. After running 60 miles on unadditized base ultra low sulfur diesel (ULSD) fuel, the fuel economy stabilized and was measured at 37.3 miles per gallon. The mixture of Example 1, comprising 17% by weight 2-ethylhexylnitrate and 83% by weight d-limonene was then added to the fuel at a concentration of 0.3 ounces per gallon. After running an additional 12 miles on this additive, the measured fuel economy was 40.1 miles per gallon, representing a fuel economy improvement of 7.5%.

EXAMPLE 3

Figure 3:
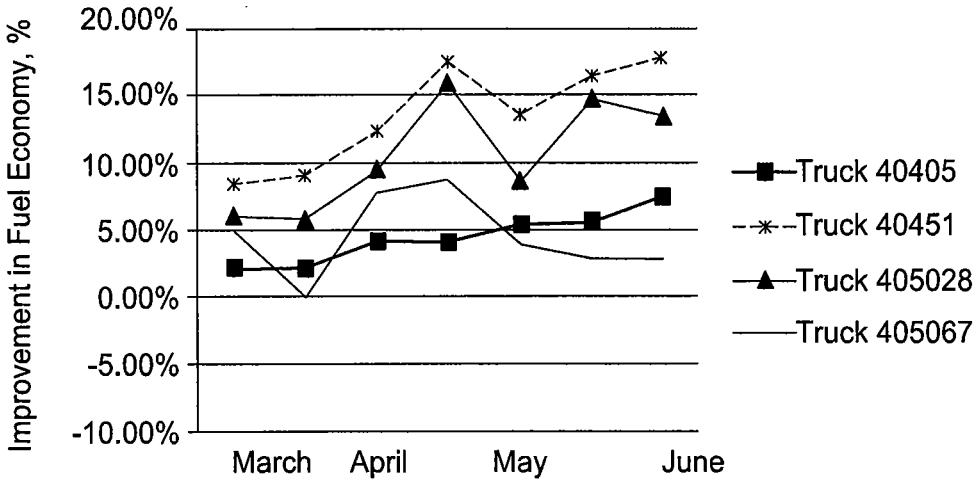
FIG. 3 shows a graph of improvement in fuel economy over time for four trucks operating on fuel mixed with an additive according to one embodiment.

Four trucks from a long haul Ohio-based fleet equipped with Cummins ISX engines were each fueled with base fuel and the additive of Example 1 at a concentration of 2500 ppm of the additive for a period of three months. The trucks were run under normal road conditions. As shown in FIG. 3, three of the four trucks tested showed significant improvement in fuel economy during the test period. One of the vehicles (truck no. 405067) did not respond positively to the chemistry. This is typical of fleet service where not all the trucks will respond to chemistry or hardware even though the engines are identical. The difference in response can usually be attributed to driver variability.

Road test fuel economy improvement results may generally be higher than the chassis dynamometer results for several reasons. Mixing of the combustion enhancer into the fuel tank of the vehicle on the dynamometer provides limited opportunity for the combustion enhancer to mix with the bulk fuel since the vehicle is strapped down to the bed plate. In road tests, mixing of the fuel and additive occurs more quickly due to fuel motion generated from stop-and-go driving. Also, the duration of the road tests are typically longer than the dynamometer tests, allowing an opportunity for the other beneficial attributes of the additive to begin to work.

FIGS. 4 through 8 show pressure versus time curves for different fuel compositions taken from combustion bomb tests using the industry standard Ignition Quality Test, ASTM 6890/08. The Table below summarizes the run conditions and resultant pressure at about 7 ms for each run.

TABLE

| FIG. | D-Limonene (wt. %) | 2EHN (wt. %) | Additive in fuel (ppm) | Approximate pressure (psi) |
|---|---|---|---|---|
| 4 | 0 | 0 | 0 | 400 |
| 5 | 100 | 0 | 4000 | 550 |
| 6 | 91 | 9 | 4300 | 650 |
| 7 | 83 | 17 | 2200 | 675 |
| 8 | 0 | 100 | 500 | 675 |

Figure 4:
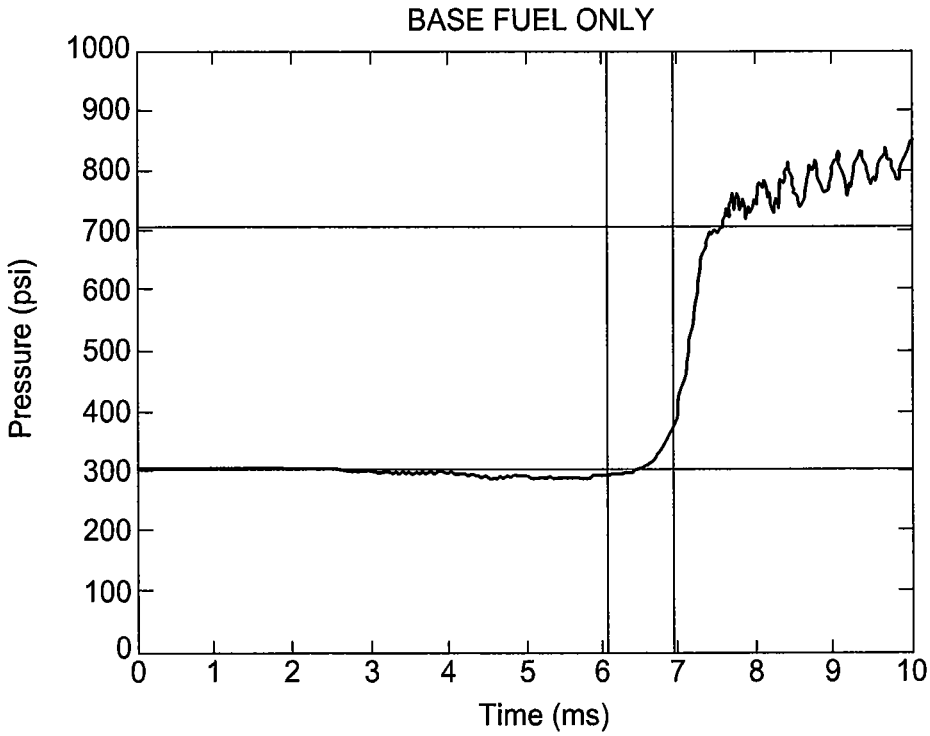
FIG. 4 shows a pressure versus time curve for base fuel.
Figure 5:
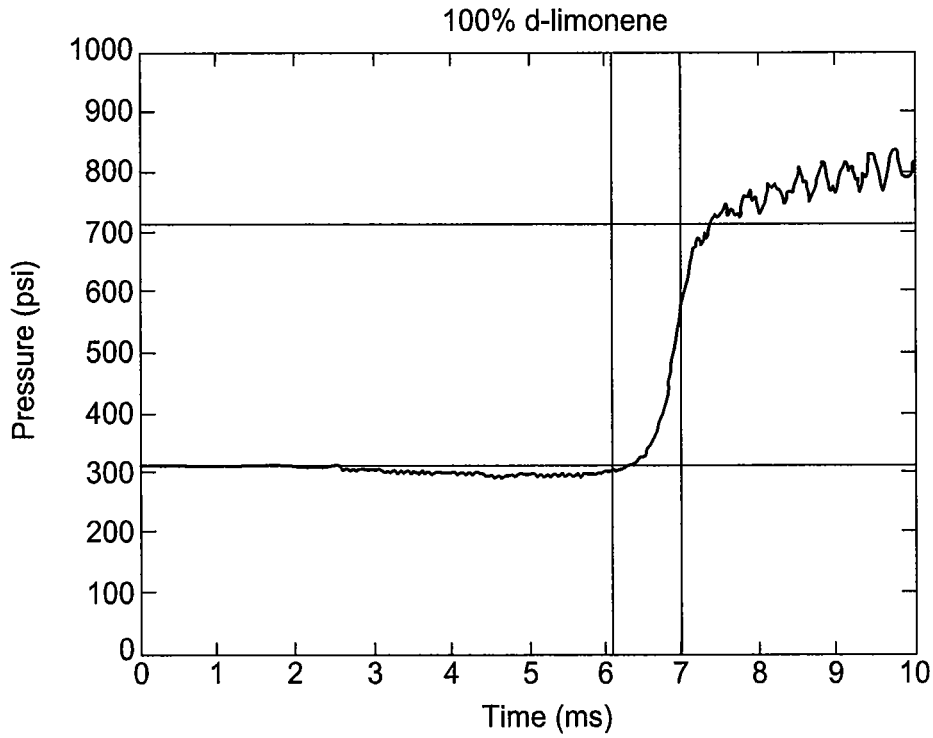
FIG. 5 shows a pressure versus time curve for fuel mixed with d-limonene.
Figure 6:
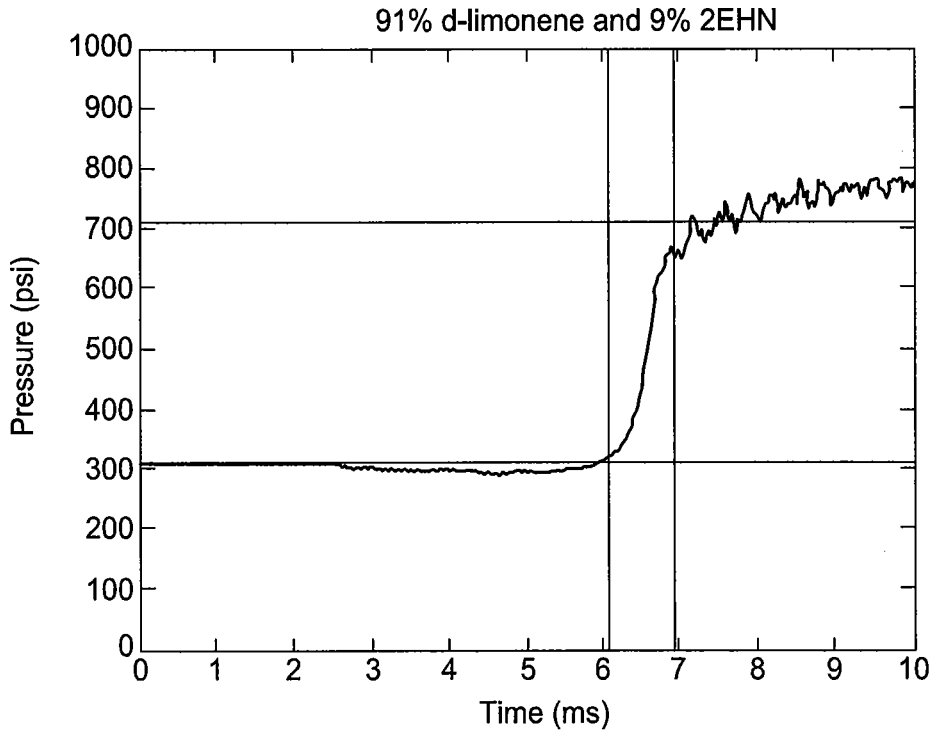
FIG. 6 shows a pressure versus time curve for fuel mixed with d-limonene and 2-ethylhexylnitrate.

FIG. 4 shows the pressure vs. time curve for base diesel fuel with no additive added. FIG. 5 shows some improvement by adding d-limonene only to the base diesel fuel. FIG. 6 shows even better improvement when an additive having about 91% d-limonene and about 9% 2-ethylhexylnitrate is added to the diesel fuel.

Figure 7:
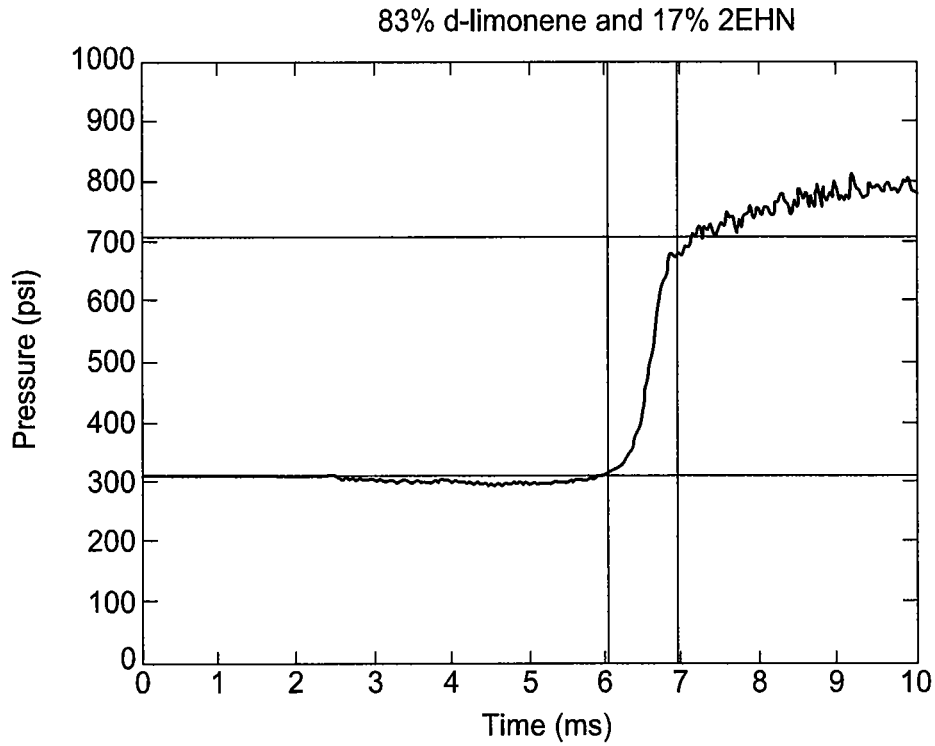
FIG. 7 shows a pressure versus time curve for fuel mixed with d-limonene and 2-ethylhexylnitrate.
Figure 8:
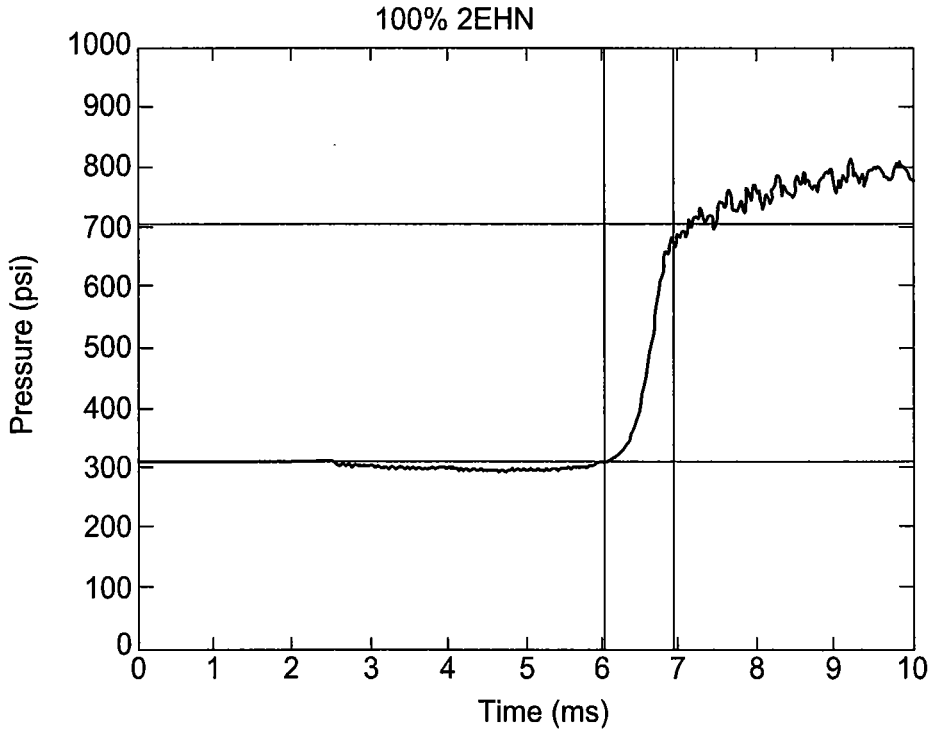
FIG. 8 shows a pressure versus time curve for fuel mixed with 2-ethylhexylnitrate.

FIG. 7 shows that adding less additive to the diesel fuel, but at a higher concentration of 2-ethylhexylnitrate resulted in further improved results. Finally, FIG. 8 shows the results for a fuel mixture having only 2-ethylhexylnitrate added. The mixture of d-limonene and 2-ethylhexylnitrate in FIG. 7 still outperformed the 2-ethylhexylnitrate only mixture as a combustion enhancer. The slope of the curve in FIG. 7 is steeper than in FIG. 8, demonstrating that more of the fuel is releasing energy earlier with the 83/17 d-limonene/2-ethylhexylnitrate combination than with the 2-ethylhexylnitrate only (the area underneath the curve represents the amount of work being done). This data shows that the d-limonene/2-ethylhexylnitrate additive acts as a fuel combustion enhancer.

While the foregoing is directed to embodiments of the present invention, other and further embodiments of the invention may be devised without departing from the basic scope thereof, and the scope thereof is determined by the claims that follow.

The invention claimed is:

1. A fuel additive consisting of a monoterpene and a cetane enhancer having a percentage composition of monoterpene by weight of between about 75% to 91% with the remainder cetane enhancer.

2. A fuel additive of claim 1 wherein the percentage composition of monoterpene by weight is between about 80% to 91% with the remainder cetane enhancer.

3. A fuel additive of claim 1 wherein the percentage composition of monoterpene by weight is between about 85% to 91% with the remainder cetane enhancer.

4. A fuel additive of claim 1 wherein the percentage composition of monoterpene by weight is about 91% with the remainder cetane enhancer.

5. The fuel additive of claim 1 wherein the monoterpene is d-limonene.

6. The fuel additive of claim 5 wherein the d-limonene is between about 93% to 100% pure.

7. The fuel additive of claim 5 wherein the d-limonene is between about 96% to 100% pure.

8. The fuel additive of claim 1 wherein the cetane enhancer is selected from a group consisting of 2-ethylhexyl nitrate, di-tert-butyl peroxide and ammonium nitrate.

9. The fuel additive of claim 1 wherein the cetane enhancer is 2-ethylhexyl nitrate.

10. A fuel composition consisting of an admixture of d-limonene and a 2-ethylhexyl nitrate providing from about 75% to 91% by weight of d-limonene and about 25% to 9% 2-ethylhexyl nitrate mixed with a diesel fuel providing about 0.0007% to about 0.01% by weight of the admixture to fuel ratio.

11. The fuel composition of claim 10 wherein the admixture provides about 0.001% to about 0.005% by weight of admixture to fuel ratio.

12. A fuel composition consisting of an admixture of a d-limonene and a 2-ethylhexyl nitrate providing about 75% to 91% by weight of d-limonene and about 25% to 9% 2-ethylhexyl nitrate mixed with a diesel fuel providing about 500 ppm to about 10,000 ppm of admixture to fuel ratio.

13. A fuel composition of claim 12 wherein the admixture mixed with a diesel fuel provides about 800 ppm to about 2,500 ppm of admixture to fuel ratio.

14. A method of preparing a fuel additive for use in a diesel fuel comprising the steps of:

combining a monoterpene of between 75% to 91% by weight with a cetane enhancer selected from a group consisting of 2-ethylhexylnitrate, di-tert-butyl peroxide and ammonium nitrate to form a fuel additive; and, combining the fuel additive to a volume of diesel fuel resulting in an combined fuel blend providing an additive mixture of an amount between about 500 ppm and 10,000 ppm.

15. A method of preparing a fuel additive for use in a diesel fuel comprising the steps of:

combining a quantity of d-limonene of between 75% to 91% by weight with a cetane enhancer selected from a group consisting of 2-ethylhexylnitrate, di-tert-butyl peroxide and ammonium nitrate to form a fuel additive; and, adding the fuel additive to a volume of diesel fuel resulting in a combined fuel blend providing an additive mixture of an amount between about 800 ppm and 2,500 ppm in the diesel fuel.

* * * * *